US005383565A

United States Patent [19]

Luch

[11] Patent Number: 5,383,565

[45] Date of Patent: Jan. 24, 1995

[54] NECK FINISH FOR CONTAINERS OF RIGID MATERIAL

[75] Inventor: Daniel Luch, Los Gatos, Calif.

[73] Assignee: Portola Packaging, Inc., San Jose, Calif.

[21] Appl. No.: 108,842

[22] Filed: Aug. 18, 1993

Related U.S. Application Data

[63] Continuation of Ser. No. 818,800, Jan. 9, 1992, abandoned, which is a continuation-in-part of Ser. No. 564,630, Aug. 8, 1990, abandoned.

[51] Int. Cl.[6] ..... B65D 1/40; B65D 41/16; B65D 41/18

[52] U.S. Cl. ..... 215/317; 215/31; 220/306

[58] Field of Search ..... 215/31, 256, 306, 317, 215/320, 321, 224; 220/306

[56] References Cited

U.S. PATENT DOCUMENTS

| | | | |
|---|---|---|---|
| 2,817,453 | 12/1957 | Stover | 215/31 |
| 3,131,824 | 5/1964 | Van Baarn | 215/31 X |
| 3,462,048 | 8/1969 | Henchert | 215/320 X |
| 3,484,016 | 12/1969 | Turner | 215/321 X |
| 3,532,244 | 10/1970 | Yates, Jr. | 215/320 X |
| 3,572,413 | 3/1971 | Livingstone | 215/31 X |
| 3,860,133 | 1/1975 | Boxer et al. | 215/224 X |
| 3,907,146 | 9/1975 | Fields | 215/317 |
| 3,934,745 | 1/1976 | Lovell | 215/224 |
| 3,946,891 | 3/1976 | Picoy et al. | 215/320 X |
| 4,078,696 | 3/1978 | Crisci | 215/317 X |
| 4,256,240 | 3/1981 | Woinarski | 215/306 |
| 4,260,067 | 4/1981 | Andruchiw | 215/317 X |
| 4,289,252 | 9/1981 | Helms | 215/321 X |
| 4,444,325 | 4/1984 | Lecinski, Jr. | 215/31 |
| 4,484,687 | 11/1984 | Bullock, III | 215/256 |
| 4,500,006 | 2/1985 | LaFortune et al. | 215/224 |
| 4,674,644 | 6/1987 | Jacobs | 215/320 |
| 4,676,389 | 6/1987 | Bullock | 215/256 X |
| 4,813,570 | 3/1989 | Pontoppidan | 215/224 X |
| 5,008,066 | 4/1991 | Mueller | 215/306 X |

FOREIGN PATENT DOCUMENTS

| | | | |
|---|---|---|---|
| 62360 | 6/1955 | France | 215/320 |
| 2564802 | 11/1985 | France | 215/317 |
| 814379 | 9/1951 | Germany | 215/317 |
| 527336 | 5/1955 | Italy | 215/317 |
| 573088 | 2/1958 | Italy | 215/31 |
| 221897 | 9/1942 | Switzerland | 215/317 |

*Primary Examiner*—Sue A. Weaver
*Attorney, Agent, or Firm*—Julian Caplan

[57] ABSTRACT

Neck finishes suitable for containers formed of rigid materials are shaped to overcome problems which would otherwise occur if standard closures which perform satisfactorily with less rigid containers are used. One problem is that plugs (inner skirts) of closures are cut or shaved if they are oversize relative to the inner neck diameter. This problem is overcome by forming a chamfer or radius at the lead-in to the inside corner of the neck. A second problem ("ovality") occurs when the neck is not uniformly round; this problem is overcome by forming a cut-out section at the upper outer corner of the neck so that the maximum neck diameter engages the inside of the outer cap skirt below the top edge, thereby lessening outward distortion of the outer skirt.

10 Claims, 3 Drawing Sheets

NECK FINISH FOR CONTAINERS OF RIGID MATERIAL

This is a continuation of application Ser. No. 07,818,800 filed Jan. 9, 1992, which was a continuation-in-part of Ser. No. 07/564,630 filed Aug. 8, 1990, both now abandoned.

BACKGROUND OF THE INVENTION

1. Field of the Invention

This invention relates to the neck finish (i.e., cross-sectional shape) of containers formed of relatively rigid materials such as polyvinyl chloride. Such neck finishes are formed to cooperate with standard push-on caps which were initially designed for use with less rigid materials such as polyolefins.

2. Prior Art

Caps used with the neck finish of this invention such as those shown in U.S. Pat. Nos. 4,676,389 and 4,484,687 as well as many variations thereof. Such caps have a top disk from which depends a substantially cylindrical outer skirt having at least one locking bead on the inside surface thereof. The neck to which the present invention relates is formed on the exterior with locking beads which mate with locking beads on the cap. Many of these caps have tamper-evident features whereby the portion of the skirt carrying the lower locking bead is torn away, leaving a reclosure cap which may be pried off the neck and used to reseal the remaining contents of the container. Some of the caps used with the neck finish have an inner skirt or plug which fits the inside of the neck.

Prior art containers for the most part have been made from relatively flexible materials such as polyolefins. Their lips having relatively sharp inner and outer peripheral corners. The outer corner engages the interior of the outer skirt of the cap promoting distortion of the skirt outwardly particularly when the cap is being used as a reclosure cap. The pliable polyolefin containers do not deform to the extent that the distortion of the closure becomes excessive.

The present invention overcomes some of the problems which occur when the less rigid polyolefin containers are replaced with more rigid containers.

SUMMARY OF THE INVENTION

Heretofore containers have been made of a relatively flexible polyolefin material wherein the lip deforms if an oversized plug seal is inserted into the orifice of the neck. The outer skirt of the cap fits over the upper locking bead of the neck and is disposed in a generally vertical position.

However, materials which are substantially more rigid than polyolefins, such as polyvinyl chloride create certain difficulties. The oversize plug of the closure is cut or shaved by the sharp inner edge of the lip since the lip does not deform as much as if a less rigid material is used. The undercut of the lip, which is conventionally formed in less rigid containers and deforms when the plug is inserted, may not be formed with less resilient materials, which are typically manufactured with injected or pressed (ram-down) finishes.

A second problem with rigid container necks arises when such necks become excessively oval shaped rather than round. In such cases, the locking bead on the exterior of the neck is forced outwardly in the areas of greatest radius, and this causes the outer cap skirt to be slanted outwardly-downwardly, even to such an extent that the locking beads of the cap and neck do not inter-engage.

In accordance with the present invention, a cut-out is formed at the corner of the intersection of the lip of the neck and the locking bead. In such event the locking bead engages the inside of the neck spaced downwardly from the lip and hence the distortion of the outer skirt from vertical is considerably minimized.

In another feature of the invention, the lead-in or inner corner where the lip intersects the orifice of the neck is formed with a chamfer or radius. This facilitates insertion of the plug of the cap.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
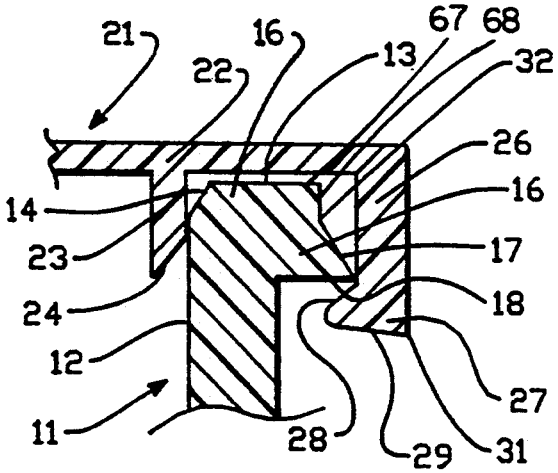
FIG. 1 is a fragmentary sectional view through a cap and container neck formed in accordance with this invention.
Figure 2:
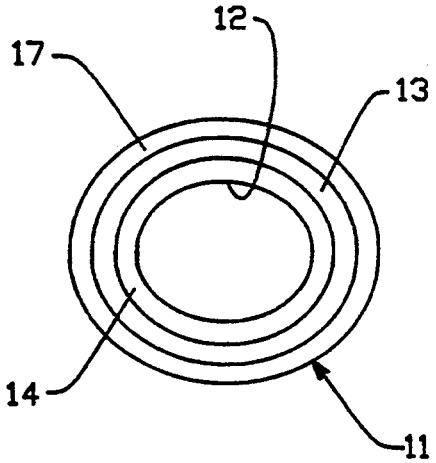
FIG. 2 is a top plan view of the neck structure.
Figure 3:
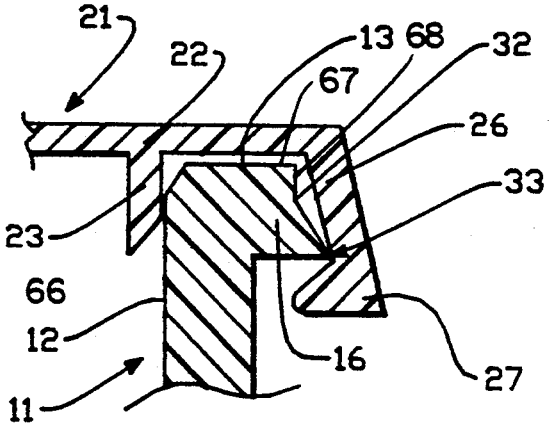
FIG. 3 is a view similar to FIG. 1 showing a neck which is distorted by ovality and illustrates the relatively small distortion of the outer skirt.

Directing attention first to the structure of FIGS. 1–3, neck 11 has an inside orifice or throat 12 and an upper lip 13. In accordance with the present invention, a lead-in chamfer or radius 14 is formed at what would otherwise be the intersection of throat 12 and lip 13.

On the exterior of neck 11 at its top is a rim 66 extending outwardly from the side wall of neck 11. Rim 66 has a top surface 67 substantially co-planar with lip 13. What would otherwise be the upper outer corner of rim 66 is formed as a cut-out 32 defined by a downward extending upper outer surface 68 (shown in FIGS. 1–4 as vertical) and a downward extending lower outer surface 17 shown in FIGS. 1–4 to be slanted downward-outward. The portion of rim 66 below cut-out 32 comprises locking beads 16. The slanted surface 17 comprises the top surface of bead 16 which intersects horizontal surface 18 extending outward from the side wall of neck 11 and comprises a bottom shoulder 18 for bead 16. As will be understood with reference to U.S. Pat. Nos. 4,676,389 and 4,484,687, below the top locking bead 16 there is generally a second locking bead which is engaged by the cap until such time as the lower portion of the cap skirt is torn away. Thereupon the upper portion of the cap becomes a reclosure cap, as is well understood in the art. The cap 21 illustrated herein is essentially a reclosure cap, it being understood that the lower portion of the outer skirt which contains the lower locking bead has been torn away. The upper outer comer of rim 66 is thus formed with cutout 32 so that the upper outer wall or surface 68 below rim top or lip 13 is greater in size than the outer surface of wall 11 for a distance approximately half the height of rim 66. Below the upper outer wall the rim slants downward-outward in a lower outer wall 17 which intersects the bottom of rim 66 to form a contact point 33 spaced downward from the rim top 13.

Cap 21 is formed with a top disk 22 from which depends an inner skirt or plug 23. In accordance with the present invention, the outer bottom edge 24 is slanted downwardly inwardly. When the cap 21 is applied to the neck 11, the lead-in 14 in cooperation with the slanted edge 24 ensures that the inner skirt 23 fits inside the throat 12 even though the neck 11 may have been distorted from a circular shape (i.e., is subject to "ovality").

Also depending from top disk 22 is cylindrical outer skirt 26 which has an upper locking bead 27 spaced downwardly from the disk 22. Bead 27 has a downward inward slanted surface 28 and a downward outward slanted surface 29 which facilitates initial capping of the cap onto the neck and also facilitates removal of the reclosure cap 21. As shown in FIG. 1 there is a bottom edge 31 to the cap 21, it being understood that the portion of the cap initially below edge 31 has been torn away.

The outer corner of bead 16 engages outer skirt 26 at a contact point 33. The position of contact point 33 is well below lip 13 because of the cut-out 32 formed above bead 16.

Figure 4:
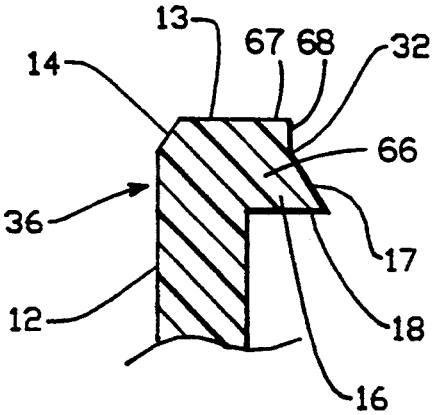
FIG. 4 is a sectional view of the neck used in FIGS. 1 and 3.

Thus directing attention to FIG. 4 which is a neck finish 36 substantially similar to that shown in FIGS. 1 and 3, the cut-out 32 occurs in that the lip 13 has an outside edge materially smaller than the diameter of the outside edge of the bead 16.

Figure 5:
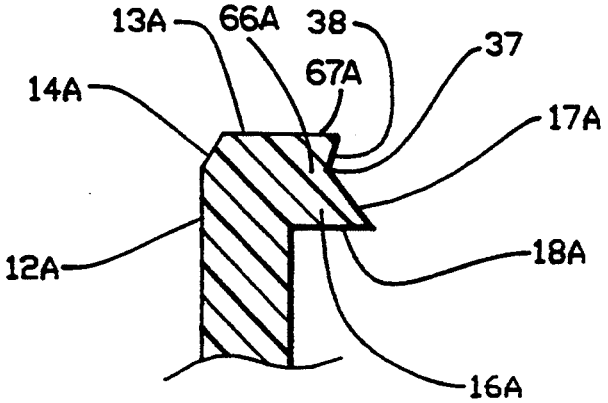
FIG. 5 is a view similar to FIG. 4 of a modified neck finish.

FIG. 5 shows a modification of the structure of FIG. 4 in that the cut-out notch 37 instead of having an upper vertical edge has a stretch 38 slanted inwardly-downwardly.

Directing attention to FIG. 6, the upper outer edge of the neck below lip **13*b* is formed with a cylindrical vertical stretch 41 which terminates in a flange 42 having substantially horizontal top and bottom surfaces 43,44**.

Figure 10:
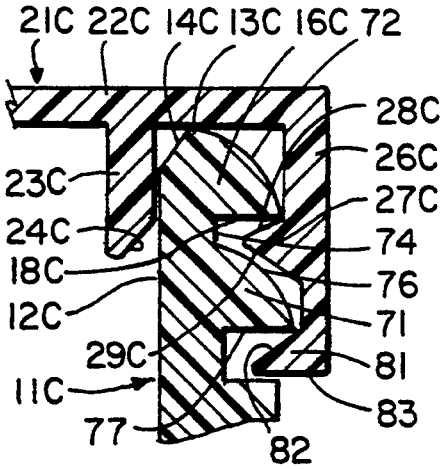
FIG. 10 is a view similar to FIG. 1 of a further modified neck finish and cap.

FIG. 10 illustrates a further modification of the invention.

Neck **11*c* has an upper locking bead 16*c* and lower locking bead 71. The upper surface 72 of bead 16*c* has a downward-outward curved top surface 72 terminating in an inward directed, substantially horizontal shoulder 18*c*. Below bead 16*c* is a short vertical stretch 74 which terminates in outward curved top surface 76 of bead which terminates in inward directed, substantially horizontal shoulder 77**.

Cap **21*c* is formed with top disk 22*c* from which depends an inner skirt or plug 23*c*, the outer bottom edge 24*c* of which is slanted downwardly-inwardly. Outer skirt 26*c* depends from the periphery of disk 22*c* having upper locking bead 27*c* spaced downward from disk 22*c*. Bead 27*c* has a downward-inward slanted surface 28*c* and a downward-outward slanted surface 29*c*. In the form of the invention shown in FIG. 10, cap 21*c* is shown with the lower cap locking bead 81 in place. Bead 81 has downward-inward slanted upper surface 82 engaging under bead 71 and a horizontal bottom edge 83**.

The invention as shown in FIG. 10 has advantages similar to those of the previous modifications in that the curvature of surface 72 produces a result similar to that of cut-out 32 shown in FIG. 1.

Figure 7:
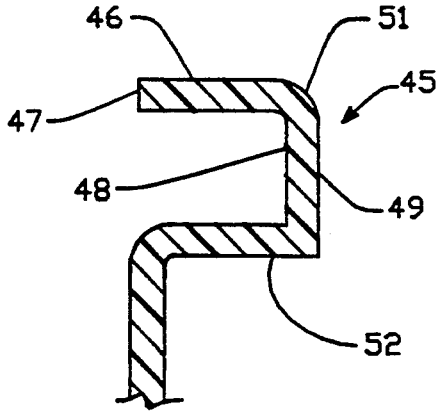
FIG.-7 (PRIOR ART)
FIGS. 7 and 8 are fragmentary vertical sectional views through prior art neck finishes.
Figure 8:
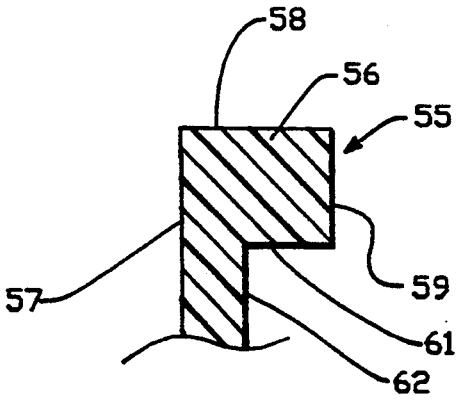
FIG.-8 (PRIOR ART)
Figure 9:
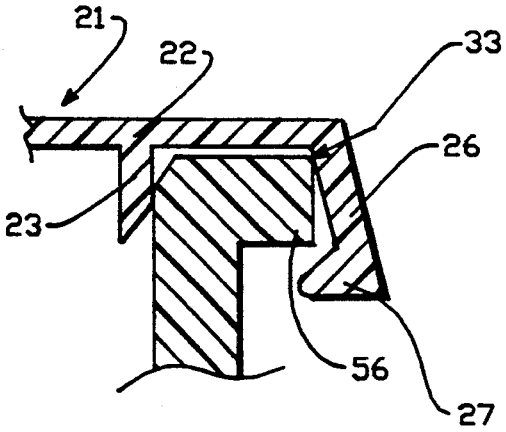
FIG.-9 (PRIOR ART)
FIG. 9 is a schematic view which should be compared with FIG. 3 to illustrate an advantage of the present invention.

Advantages of the present invention will be shown by comparison with examples of the prior art illustrated in FIGS. 7, 8 and 9. FIG. 7 illustrates a common type of neck finish used in blow-molded polyolefin container 45. Thus lip 46 has an inner edge 47 and below edge 47 is an undercut 48 which makes the lip 46 quite flexible. Formation of the undercut 48 is relatively easy for blow-molded bottles but is difficult or impossible when the bottle finish is formed by injection or a ram-down pressed operation. The neck finish of FIG. 7 has an outside cylindrical portion 49, the corner 51 being rounded and the lower end of the cylindrical portion 49 terminating in a relatively horizontal inward directed shoulder 52. The caps shown in FIGS. 1 and 3 are designed for closing neck finishes such as shown in FIG. 7.

FIG. 8 shows another prior art neck structure 55 of a relatively rigid material which is formed by injection or ram-down operation. Thus there is a solid flange 56 which has an inside surface 57 functioning as the throat of the neck and a horizontal broad top lip 58. Outer cylindrical surface 59 terminates on its lower end in a horizontal inwardly directed shoulder 61 which in turn is connected to the lower neck 62. Structures such as shown in FIG. 8 have certain problems. First, excessive mass results in extended process times, material waste and difficult dimensional control. Second, the absence of a lead-in chamfer results in difficult plug insertion and capping. Third, extension of the top surface outward to the outside diameter leads to exaggerated distortion of the closure from bottle ovality resulting from process or use.

In accordance with the present invention, the cut-out section 32 not only saves mass but has the important additional function of accommodating bottle distortions. Directing attention to FIG. 9, it will be seen that with a neck shape having a solid flange 56 such as that shown in FIG. 8, the point of contact 33 causes the outer skirt to slant downward outward so that the bead 27 does not even engage the flange 56. Although FIG. 9 is somewhat distorted for the purpose of illustration, by comparison with FIG. 3 it will be seen that even though the distortion of the bead 16 is as great as the flange 56, the outer skirt 26 of FIG. 3 is much more nearly vertical and there is an inter-engaging of the bead 16 with the bead 27 which maintains the reclosure cap 21 on the neck 11 against unintentional removal. Therefore the cut-out 32 results in less cap distortion because contact point 33 is lower. The cut-out allows the closure to remain securely fastened to the neck through a wide range of finish ovalities. It will be understood that such ovality may result from process, shock "impacts," or compression during consumer use.

It is important that the lip 13 be sufficiently wide so that if, instead of an inner skirt or plug 23, a seal is effected by induction heating of transfer foils, there is sufficient annular area of lip 13 to ensure consistent sealing with the foil.

Figure 6:
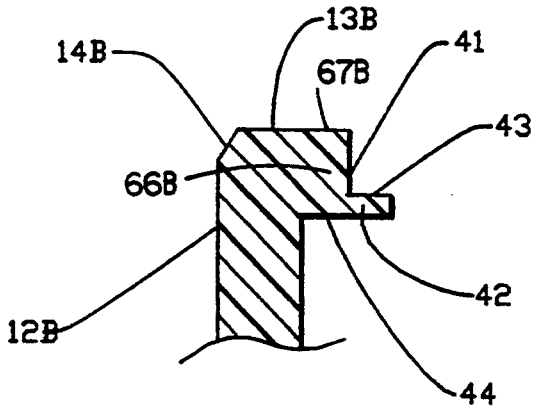
FIG. 6 is a view similar to FIG. 4 of another neck finish.

The elements of the modifications of FIGS. 5, 6 and 10 in many respects resemble those of the preceding modification and the same reference numerals followed by the subscripts a, b and c, respectively, refer to corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A container neck formed of a rigid plastic material which is subject to distortion into an oval shape comprising a side wall having inner and outer wall surfaces, a lip at the top of said side wall, a rim around said outer wall surface having a rim top joined to said lip and terminating in an outer upper corner, the outside of said rim being substantially greater in size than said outer wall surface, said rim comprising a continuous peripheral locking bead, characterized in that said outer upper corner of said rim is formed with a cutout defined in part by a downward extending upper outer wall of said rim below said rim top being greater in size than said outer wall surface for a distance approximately half the height of said rim and below said upper outer wall said rim cutout slants downward-outward in a lower outer wall which intersects the bottom of said rim to form a contact point spaced downward from said rim top.

2. A neck according to claim 1 in which the upper inner edge of said lip is formed with a chamfer.

3. A neck according to claim 1 in which said downward extending upper outer wall is substantially vertical.

4. A neck according to claim 1 in which said upper outer wall slants downward-inward.

5. In combination, a cap having a top, a peripheral substantially vertical outer skirt depending from said top and an internal locking bead on said outer skirt spaced downward from said top, and a container having a neck formed of a rigid plastic material which is subject to distortion into an oval shape comprising a side wall having inner and outer wall surfaces, a lip at the top of said side wall, a rim around said outer wall surface having a rim top joined to said lip and terminating in an outer upper corner, the outside of said rim being substantially greater in size than said outer wall surface, said rim comprising a continuous peripheral locking bead, characterized in that said outer upper corner of said rim is formed with a cutout defined in part by a downward extending upper outer wall of said rim below said rim top being greater in size than said outer wall surface for a distance approximately half the height of said rim and below said upper outer wall said rim cutout slants downward-outward in a lower outer wall which intersects the bottom of said rim to form a contact point spaced downward from said rim top, said contact point engaging the inside of said outer skirt of said cap immediately above said internal locking bead.

6. The combination of claim 5 in which said cap is formed with a central hollow plug and the upper inner edge of said lip is formed with a chamfer to direct said plug to fit inside said inner wall surface of said neck.

7. The combination of claim 5 in which said upper outer wall is substantially vertical.

8. A container neck formed of a rigid plastic material which is subject to distortion into an oval shape comprising a side wall having inner and outer wall surfaces, a lip at the top of said side wall, a rim around said outer wall surface having a rim top substantially co-planar with said lip terminating in an outer upper corner, the outside of said rim being substantially greater in size than said outer wall surface, said rim comprising a continuous peripheral locking bead, characterized in that said outer upper corner of said rim is formed with a cutout defined in part by a downward extending upper outer wall of said rim below said rim top being greater in size than said outer wall surface, the upper outer wall of said rim extending downward with a lower outer wall extending in an approximately horizontal-outward stretch and then in a vertical downward stretch which intersects the bottom of said rim, said vertical downward stretch comprising a contact wall spaced downward from said rim top.

9. In combination, a neck according to claim 8 and a cap having a top a peripheral substantially vertical outer skirt depending from said top and an internal locking bead spaced downward from said top said contact wall engaging the inside of said outer skirt of said cap immediately above said internal locking bead.

10. A container neck formed of a rigid plastic material which is subject to distortion into an oval shape comprising a side wall having inner and outer wall surfaces, a lip at the top of said side wall, a rim around said outer wall surface having a rim top joined to said lip and terminating in an outer upper corner, the outside of said rim being substantially greater in size than said outer wall surface, said rim comprising a continuous peripheral locking bead, characterized in that said outer upper corner of said rim is formed with a cutout defined in part by a substantially vertical first stretch having a diameter greater in size than said outer wall surface, a substantially horizontal second stretch at the bottom of said first stretch and a substantially vertical third stretch at the outer end of said second stretch having a diameter greater than said first stretch which intersects the bottom of said rim to form a contact point spaced downward from said rim top.

* * * * *